US005217469A

United States Patent [19]

Dolev

[11] Patent Number: 5,217,469

[45] Date of Patent: Jun. 8, 1993

[54] ROTARY HEAD SPRING-LOADED TWEEZER HAIR REMOVAL DEVICE

[76] Inventor: Moshe Dolev, 22 Yehiam St., Ramat Hasharon, Israel

[21] Appl. No.: 826,427

[22] Filed: Jan. 27, 1992

[51] Int. Cl.[5] ..... A45D 26/00

[52] U.S. Cl. ..... 606/133; 606/131

[58] Field of Search ..... 606/131, 133

[56] References Cited

U.S. PATENT DOCUMENTS

| | | | |
|---|---|---|---|
| 4,960,422 | 10/1990 | Demeester | 606/133 |
| 5,032,126 | 7/1991 | Cleyet et al. | 606/133 |
| 5,057,116 | 10/1991 | Zucker | 606/133 |
| 5,100,413 | 3/1992 | Dolev | 606/133 |
| 5,100,414 | 3/1992 | Dolev | 606/133 |

FOREIGN PATENT DOCUMENTS

| | | | |
|---|---|---|---|
| 0442419 | 8/1991 | European Pat. Off. | 606/133 |
| 0443914 | 8/1991 | European Pat. Off. | 606/133 |
| 9103964 | 4/1991 | World Int. Prop. O. | 606/133 |

*Primary Examiner*—Stephen C. Pellegrino

*Assistant Examiner*—Glenn K. Dawson

*Attorney, Agent, or Firm*—Edward Langer

[57] ABSTRACT

A hair removal device having a plurality of spring-loaded tweezers mounted on a rotary head and arranged to open and close during rotation, to trap and pluck skin hair over a relatively wide area. In a preferred embodiment, the rotary head spring-loaded tweezer design is provided as a hand-held, motor-powered depilatory device having a rotor provided with a plurality of tweezers having fixed and pivotable elements mounted on either side thereof, with the pivotable elements being operated by a set of roller pairs mounted so as to engage the tweezer upper ends. As the rotary head rotates about a shaft, the tweezer upper ends pass between the roller pairs and are depressed and released in synchronous fashion, causing them to open and close. When passed over the skin, the tweezers on the rotary head operate in two-sided fashion by opening and closing over a wide area, grasping skin hair in this area and plucking it as the tweezers close, to perform the hair removal function.

16 Claims, 2 Drawing Sheets

ROTARY HEAD SPRING-LOADED TWEEZER HAIR REMOVAL DEVICE

FIELD OF THE INVENTION

The present invention relates to motorized depilatory devices for removing unwanted skin hair, and more particularly, to a new and useful hair removal device having a rotary head containing spring-loaded tweezer elements for plucking skin hair.

BACKGROUND OF THE INVENTION

The prior art of motor-powered depilatory devices using springs for removing skin hair is based on a well-known concept of an early hand-operated device disclosed in Swiss Pat. 268,696 to Fischer, which uses an arched coil spring to trap and pluck hair between its loops as it rolls over the skin.

Other hand-operated coil spring designs are disclosed in the group including Swiss Patent 179,261 to Macioce, U.S. Pat. No. 2,458,911 to Kerr, U.S. Pat. No. 2,486,616 to Schubiger, British Pat. No. 203,970 to Davis, U.S. Pat. No. 1,743,590 to Binz, and U.S. Pat. No. 1,232,617 to Shipp. These vary in the mechanical arrangements for stretching the spring and engaging the hair between its loops before trapping the hair upon spring closure.

U.S. Pat. No. 4,079,741 to Daar et al. discloses a single tension spring disposed parallel to the skin and arranged to be stretched and compressed so as to pluck hairs trapped between its loops. The overall design is complicated and expensive.

An arched helical spring provided with high speed rotational motion for opening and closing the loops is provided in U.S. Pat. No. 4,524,772 to Daar et al. U.S. Pat. Nos. 4,726,375 and 4,807,624 to Gross et al. disclose a rubber hair-plucking element with partially circumferential slits or rubber discs for trapping and plucking skin hair.

U.S. Pat. No. 1,923,415 to Bingham discloses a plurality of rotatable discs arranged to be bent one or more times toward each other at a point in each revolution, to pluck bird feathers.

French Patent 1,017,490 to Bachofen discloses a bird feather plucking device using a set of rotatable discs, each disc having a curved surface area, and being arranged to be bent toward one another at a point during each revolution.

Another device for removing bird feathers is disclosed in French Patent 1,123,971 to Jadoul, using a plurality of rotatable discs compressed together at a point in each revolution.

Still another poultry feather plucking device is disclosed in U.S. Pat. No. 2,496,223 to Lanzisera, based on the use of a spring rotating on one side of a grid to pluck feathers.

In general, the spring and disc designs available for feather plucking are not applicable to hair plucking, due to their size, complicated construction and inefficient operation.

Another disc design is disclosed in U.S. Pat. No. 2,900,661 to Schnell, wherein a pair of discs rotate at a large angle to each other and converge at a point whereat hairs are plucked.

In U.S. Pat. No. 4,575,902 to Alazet, there is disclosed a depilatory device comprising a series of adjacent, closely-spaced hair-plucking discs driven by an electric motor. In one embodiment, the discs are periodically deformed during rotation so as to trap hair between them as they are pressed together.

In the second embodiment disclosed in the Alazet patent, a pair of movable hair-gripping combs are positioned between adjacent discs to provide hair plucking when they are applied against the discs.

In European patent 0147,285 to Alazet, there is disclosed a rotor with flexible discs and cam means to force the discs together to trap hairs and rip them out of the skin.

In U.S. Pat. No. 4,917,678 to Locke there is disclosed a rotary depilating device that catches hairs between rotating heads having peripheral teeth which cooperate with each other.

In U.S. Pat. No. 5,032,126 to Cleyet, there is disclosed a depilating device with a rotary head having a plurality of tweezers, each blade of each tweezer set being movable by cams.

In my previous U.S. Pat. Nos. 4,935,024 and 5,057,115 there is disclosed a novel coupled-disc element which reduces the painful sensation caused by spring "winding" of previous designs.

It would therefore be desirable to provide a power-driven depilatory device which provides efficient hair removal by increasing the number of hair plucking operations using a simplified construction.

It would also be desirable to provide a depilatory device which is simple in construction for cost-effective production, while being durable in use.

Additionally, it would be desirable to provide a depilatory device which minimizes pain in relation to prior art spring designs and achieves greater efficiency with respect to prior art discs designs, while being simple to manufacture, use and maintain.

SUMMARY OF THE INVENTION

Accordingly, it is a principal object of the invention to provide a hair removal device having spring-loaded tweezer elements mounted on a rotary head and arranged to pluck skin hair.

In accordance with a preferred embodiment of the present invention, there is provided a rotary head spring-loaded tweezer depilatory device comprising in combination:

a housing;

rotary head means comprising a plurality of spring-loaded tweezers each comprising at least one pivotably movable element, a spring maintaining said tweezers closed with the upper ends thereof spaced apart and the lower ends thereof in contact with one another, the upper ends of said tweezers being releasably depressable to operate said tweezers by opening the lower ends thereof, said rotary head means being arranged to rotate about a shaft seated within said housing substantially perpendicular to a skin area from which hair is to be removed;

a motor disposed in said housing and being arranged to drive said rotary head means about said shaft; and cam means arranged to cause repetitive depression and release of the tweezer upper ends synchronous with rotation of said rotary head means about said shaft, such that when placed near the skin, rotation of said rotary head means about said shaft causes each of said tweezers to alternately open and close, trapping skin hair therein when opened and plucking it when closed.

In the preferred embodiment, the rotary head spring-loaded tweezer design is provided as a hand-held, motor-powered depilatory device having a plurality of releasably depressable tweezer elements. Each of the tweezer elements is arranged as a pair of vertically extending pivotable elements and a fixed element. The pivotable elements are spring-loaded and operable to open and close against the fixed element. A set of cams are provided as oppositely-facing pairs of rollers each rotating on a shaft fixedly mounted in the housing above the rotary head. As the rotary head rotates, the tweezer upper ends pass between the roller pairs and are depressed and released in synchronous fashion, causing the tweezers to open and close.

When passed over the skin, the spring-loaded tweezers on the rotary head open and close on either side of the fixed element, doubling the number of tweezers operating to grasp and pluck the skin hair, and increasing the hair removal efficiency.

Each tweezer and its parts has a curved design like that of the rotor to aid in guiding the hairs into the tweezer for plucking during rotation, minimizing the tendency of hairs to slip from between the tweezers.

The inventive rotary head spring-loaded tweezer design has many advantages over the prior art, including simple construction, for cost-effective production, and ease of use.

Other features and advantages of the invention will become apparent from the drawings and the description contained hereinbelow.

BRIEF DESCRIPTION OF THE DRAWINGS

For a better understanding of the invention with regard to the embodiments thereof, reference is made to the accompanying drawings, in which like numerals designate corresponding elements or sections throughout and in which.

DETAILED DESCRIPTION OF A PREFERRED EMBODIMENT

Figure 2:
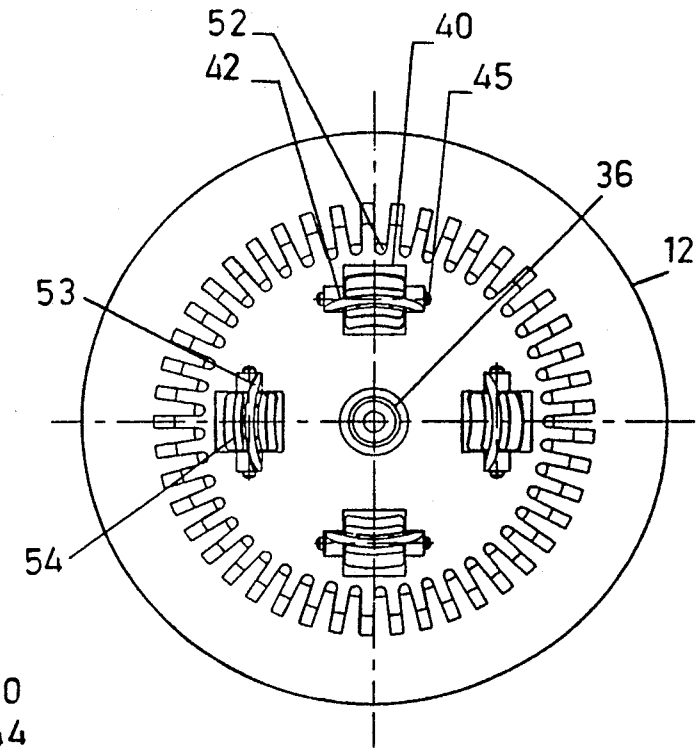
FIG. 2 is a bottom view of the hair removal device of FIG. 1.
Figure 1:
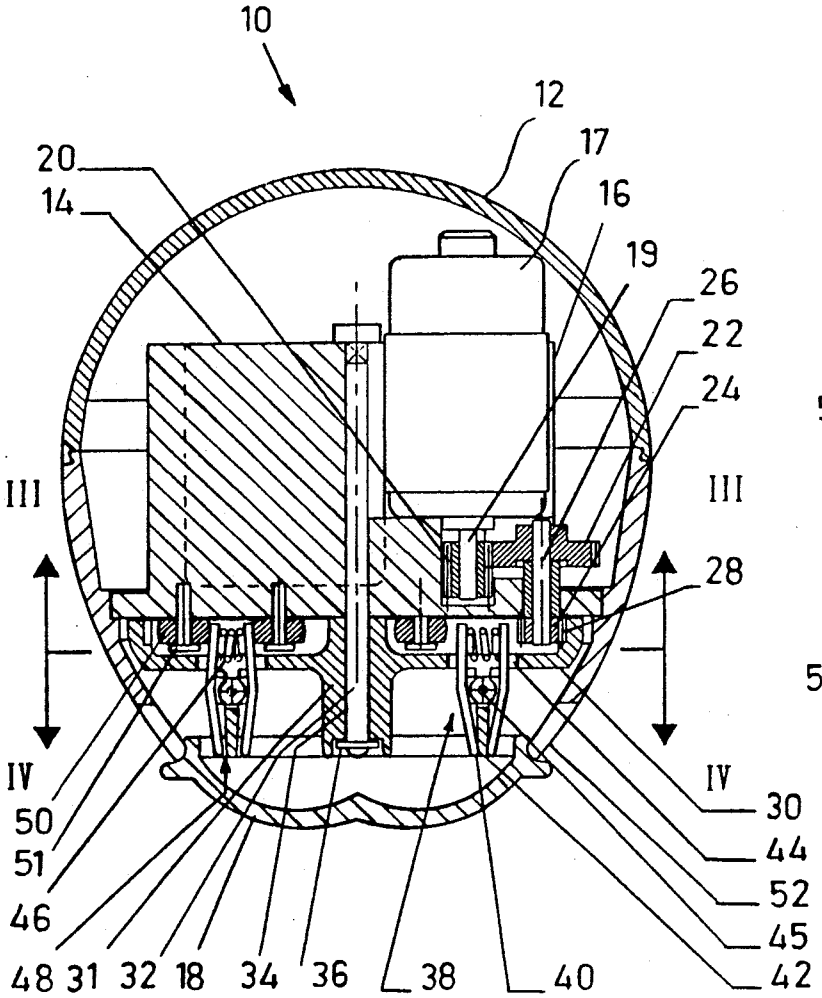
FIG. 1 is a cross-sectional elevation view of a preferred embodiment of a rotary head spring-loaded tweezer hair removal device constructed and operated in accordance with the principles of the present invention.

Referring now to FIGS. 1-2, there are shown cross-sectional elevation and bottom views of a preferred embodiment of a rotary head multi-tweezer hair removal device 10 constructed and operated in accordance with the principles of the present invention. Device 10 comprises a housing 12 enclosing and supporting a base 14, with a motor compartment 16 formed in base 14 and a miniature electric motor 17 disposed therein. The lower end of housing 12 is open, and has a removable cover plate 18.

A drive shaft 19 of motor 17 has mounted thereon a gear 20, which meshes with a gear 22 to provide rotational power to a drive gear 24 mounted on a shaft 26. Drive gear 24 meshes with an inward-facing gear 28 mounted on a rotary head 30 arranged in housing 12 opposite the skin from which hair is to be plucked. Thus, rotary power is transferred to rotary head 30 via gear 20, gear 22, drive gear 24 and gear 28.

Rotary head 30 is shaped as a disc having formed at its center a hub 31 which rotates about a shaft 32 extending through a central borehole 34 of hub 31. A retaining ring 36 retains hub 31 on shaft 32, which has its upper end seated in base 14.

Rotary head 30 supports a plurality of tweezers 38 which extend vertically therefrom toward the open end of housing 12, each tweezer 38 comprising pivotable elements 40 and a fixed element 42. Fixed elements 42 are integrally formed with rotary head 30 and extend vertically therefrom, and each of pivotable elements 40 is seated in an opening 44 formed above each fixed element 42. A pair of pivotable elements 40 is mounted on a fixed element 42, with each element 40 pivoting about a shaft 45 extending through each of fixed elements 42. This arrangement stabilizes the pivoting movement of pivotable elements 40.

The upper ends of pivotable elements 40 are maintained spaced apart from one another by a compression spring 46, so that the lower ends of tweezers 38 are normally closed. Each pivotable element 40 is seated in opening 44 opposite a fixed element 42. This design enables two-sided operation of tweezers 38, as further described herein. When the tweezers open, a pair of spaces 48 are defined between pivotable elements 40 and each of fixed elements 42.

On the lower side of base 14 there are mounted a plurality of roller pairs 50 acting as cams which operate the tweezers 38. During rotation of rotary head 30, the upper ends of tweezers 38 pass between the inner-facing edges of each oppositely-mounted roller pair 50. When the upper ends of tweezers 38 come into contact with roller pairs 50, they are depressed, causing the lower ends of tweezers 38 to open, providing spaces 48 in which hair enters. Each of roller pairs 50 is mounted on a shaft 51 seated in base 14.

It will be appreciated that tweezers 38 may be redesigned for scissor-like operation and compression spring 46 replaced by a tension spring connected between the tweezer lower ends. The roller pairs 50 may be rearranged so that the upper tweezer ends pass over the outer edges of roller pairs 50, outwardly depressing the upper tweezer ends and pushing them apart.

As shown in the bottom view of FIG. 2, the lower side of housing 12 is formed with edges 52 shaped as teeth provided in a comb-like design. The comb assists in directing the hair to be plucked toward the tweezers 38 as device 10 passes over the skin. Each of fixed elements 42 has a curved lower edge 53 (FIG. 2) which comes into contact with the lower edges 54 of pivotable elements 40 when a tweezer-like hair plucking operation is provided and spaces 48 close. Since each of pivotable elements 40 is disposed on either side of a fixed element 42, two-sided tweezer 38 operation is achieved by contact of lower edges 54 with lower edge 53 on either side of the fixed elements 42, when tweezer 38 closes. The spring force of compression spring 46 is designed to be just sufficient to grasp the hair and pluck it.

Figure 3:
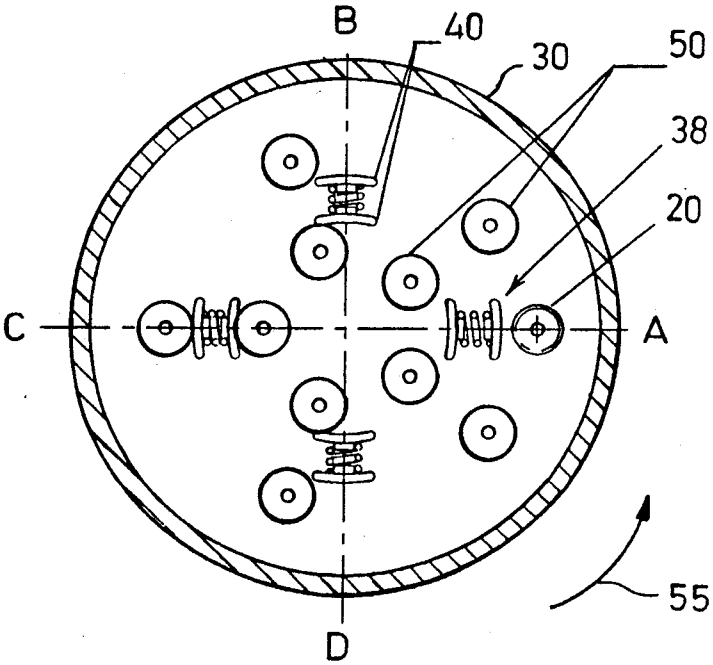
FIG. 3 is a bottom cross-sectional view of the rotary head taken along section lines III—III of FIG. 1.

In the bottom cross-sectional view of FIG. 3 taken along section lines III—III of FIG. 1, the arrangement of roller pairs 50 is shown on the lower side of base 14. Tweezers 38 are shown with pivotable elements 40 passing between oppositely-mounted rollers, causing the upper ends of tweezers 38 to become depressed together, and opening the lower ends to provide spaces 48. When the upper tweezer ends pass beyond roller pairs 50, they are released, quickly closing tweezers 38 against fixed element 42.

Figure 4:
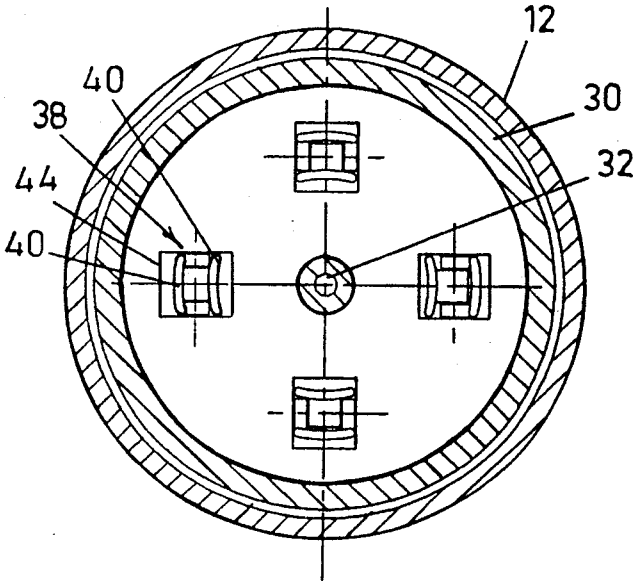
FIG. 4 is a top cross-sectional view of the rotary head taken along section lines IV—IV of FIG. 1.

In FIG. 4, there is shown a top cross-sectional view of rotary head 30 taken along section lines IV—IV of FIG. 1, revealing further construction details of tweezers 38.

In operation, when motor 17 is powered by batteries or supplied with power by a conventional cord and plug connection (not shown), drive shaft 19 transfers rotational power to rotary head 30 via reduction drive gears 22, 24 and 28. Rotation of rotary head 30 causes tweezers 38 to rotate with respect to roller pairs 50, which remain fixed in position. During this rotation, the upper ends of tweezers 38 engage roller pairs 50 and are forced to pass between their inner-facing edges. Thus, tweezers 38 are depressed and their lower ends open, and upon passing beyond roller pairs 50, they are released synchronous with rotary head 30 rotation, opening and closing tweezers 38 and providing a tweezer-like hair plucking operation.

As will be understood by examination of FIG. 3, during its rotation in the direction of arrow 55, tweezers 38 are shown at radial locations A, B, C and D. At location A, tweezers 38 are closed. Tweezers 38 which are disposed at the rotation position corresponding to location B are about to open. Tweezers 38 which have rotated into location C are open as they pass between innerfacing edges of roller pairs 50, which depress the upper ends of tweezers 38 together. Continued rotation of tweezers 38 until location D causes them to re-close before the next roller pair 50.

In accordance with the inventive design, lower edges 53 of fixed elements 42 and lower edges 54 of pivotable elements 40 are curved to aid in "combing" the hair during rotation, and guiding them into spaces 48 wherein they are grasped and plucked, minimizing the tendency of hairs to slip out of spaces 48. Tweezers 38 approach the hair to be plucked from all directions, by combination of the rotary head 30 rotation and the movement of hair removal device 10 over the skin. This feature of the inventive design insures efficient hair plucking operations.

When passed over the skin, the spring-loaded tweezers 38 arranged on rotary head 30 are each operated sequentially in a fixed pattern, by opening and closing, so they grasp and pluck skin hair over a wide area. This occurs because individual hairs in a given skin area are trapped by tweezers 38 in spaces 48 during a portion of head 30 rotation, and these hairs are plucked when rotation continues and tweezers 38 close. During continued rotary head 30 rotation, tweezers 38 open and release these hairs.

In accordance with the principles of the present invention, the rotary head spring-loaded tweezer design is an efficient mechanical design, allowing for cost-effective production and insuring simplicity of use. In addition, the inventive design achieves more plucking operations per rotary head 30 revolution, since it is continuously in contact with the skin and, at any instant, one of the tweezers 38 may be operated.

Having described the invention with regard to certain specific embodiments, it is to be understood that the description is not meant as a limitation since further modifications will now suggest themselves to those skilled in the art and it is intended to cover such modifications as fall within the scope of the appended claims.

I claim:

1. A rotary head spring-loaded tweezer depilatory device comprising in combination:

a housing;

rotary head means comprising a disc having a plurality of fixed elements integrally formed therewith, each fixed element comprising a member extending vertically from said disc, said disc having formed therein above each of said fixed elements an opening, a plurality of spring-loaded tweezers each comprising a pair of pivotably movable elements extending through said opening on either side and opposite one of said fixed elements and arranged to pivot thereon, a spring maintaining said tweezers closed with upper ends thereof spaced apart and lower ends thereof in contact with said fixed element, a pair of spaces being defined between said fixed and pivotably movable, said tweezer upper ends being releasably depressable to operate said tweezers by opening said lower ends thereof, said rotary head means being arranged to rotate about a shaft seated within said housing substantially perpendicular to a skin area from which hair is to be removed;

a motor disposed in said housing and being arranged to drive said rotary head means about said shaft; and cam means arranged to cause repetitive depression and release of said tweezer upper ends synchronous with rotation of said rotary head means about said shaft, such that when placed near the skin, rotation of said rotary head means about said shaft causes each of said tweezers to alternately open and close, trapping skin hair in said spaces when opened and plucking it when closed.

2. The device of claim 1 wherein said spaces on either side of said fixed element provide for two-sided tweezer operation in plucking hair trapped when each tweezer closes.

3. The device of claim 1 wherein said housing is formed with edges shaped to provide combing of said skin hair, guiding it within said spaces to insure plucking.

4. The device of claim 3 wherein said combing is multi-directional to insure efficient hair plucking.

5. The device of claim 1 wherein said cam means comprises a plurality of oppositely-mounted roller pairs disposed in said housing above and in proximity to said disc, said tweezer upper ends passing between inner-facing edges of said roller pairs and exiting therefrom during rotary head rotation, to depress and release said tweezers.

6. The device of claim 1 wherein said spring maintains said tweezers closed with a spring force just sufficient to grasp hair and pluck it.

7. A method of removing unwanted skin hair comprising the steps of:

providing a spring-loaded tweezer hair plucking means coupled to a means of rotational power, said hair plucking means comprising:

a housing having rotary head means comprising a disc having a plurality of fixed elements integrally formed therewith, each fixed element comprising a member extending vertically from said disc, said disc having formed therein above each of said fixed elements an opening, a plurality of spring-loaded tweezers each comprising a pair of pivotably movable elements extending through said opening on either side and opposite one of said fixed elements and arranged to pivot thereon, a spring maintaining said tweezers closed with upper ends thereof spaced apart and lower ends thereof in contact with said fixed element, a pair of spaces being defined between said fixed and pivotably movable elements, said tweezer upper ends being releasably depressable to operate said tweezers by opening said lower ends thereof, said rotary head means being arranged to rotate about a shaft seated within said housing substantially perpendicular to a skin area from which hair is to be removed; and cam means arranged to cause repetitive depression and release of said tweezer upper ends synchronous with rotation of said rotary head means about said shaft; and rotating said spring-loaded tweezer hair plucking means while it is passed over the skin, engagement of said cam means with said tweezer upper ends causing said tweezers to alternately open and close, trapping skin hair in said spaces when opened and plucking it when closed.

8. The method of claim 7 wherein said rotary head means is in continuous contact with the skin, allowing said tweezers to trap and pluck skin hair at any time during said rotation.

9. The method of claim 8 wherein each of said tweezers provides for two-sided tweezer operation in plucking hair trapped when each tweezer closes.

10. The method of claim 9 wherein said housing is formed with comb-shaped edges such that during passage of said hair plucking means over the skin, hair is combed and guided within said spaces to insure plucking.

11. The method of claim 10 wherein said combing is multi-directional to insure efficient hair plucking.

12. The method of claim 7 wherein said rotating step is performed by an electrically-powered motor disposed in said housing and arranged to drive said rotary head means.

13. The method of claim 7 wherein said spring maintains said tweezers closed with a spring force just sufficient to grasp hair and pluck it.

14. A rotary head spring-loaded tweezer depilatory device comprising in combination:

a housing;

rotary head means comprising a disc having a plurality of fixed elements integrally formed therewith, each fixed element comprising a member extending vertically from said disc, said disc having formed therein above each of said fixed elements an opening, a plurality of spring-loaded tweezers each comprising one of said fixed elements and at least one pivotably movable element extending through said opening on a side and opposite said one of said fixed elements and arranged to pivot thereon, a spring maintaining each of said tweezers closed with an upper end of each of said pivotably movable elements spaced apart from a support affixed to said disc, and a lower end of each of said pivotably movable elements in contact with said fixed element, a space being defined between each of said fixed and pivotably movable elements, each of said upper ends being releasably depressible to operate said tweezers by opening each of said lower ends, said rotary head means being arranged to rotate about a shaft seated within said housing substantially perpendicular to a skin area from which hair is to be removed;

a motor disposed in said housing and being arranged to drive said rotary head means about said shaft; and cam means arranged to cause repetitive depression and release of said upper ends synchronous with rotation of said rotary head means about said shaft, such that when placed near the skin, rotation of said rotary head means about said shaft causes each of said tweezers to alternately open and close, trapping skin hair in said space when opened and plucking it when closed.

15. The device of claim 14 wherein said housing is formed with edges shaped to provide combing of said skin hair, guiding it within said spaces to insure plucking.

16. The device of claim 15 wherein said combing is multi-directional to insure efficient hair plucking.

* * * * *